US005878946A

United States Patent [19]

Frerot et al.

[11] Patent Number: 5,878,946

[45] Date of Patent: Mar. 9, 1999

[54] CARTON OR CARTON COVER OF RIGID SHEET MATERIAL WITH REINFORCED HANDLE, BLANK AND PROCESS FOR MANUFACTURING SUCH A CARTON OR SUCH A COVER

[75] Inventors: Stéphane Frerot, Julienne; Jean-Claude Moreau, Gimeux; Gérard Mathieu, Cergy, all of France

[73] Assignee: OTOR, Paris, France

[21] Appl. No.: 702,687

[22] PCT Filed: Dec. 29, 1995

[86] PCT No.: PCT/FR95/01756

§ 371 Date: Aug. 26, 1996

§ 102(e) Date: Aug. 26, 1996

[87] PCT Pub. No.: WO96/20874

PCT Pub. Date: Jul. 11, 1996

[30] Foreign Application Priority Data

Jan. 2, 1995 [FR] France ..... 95 00014

[51] Int. Cl.[6] ..... B65D 5/462

[52] U.S. Cl. ..... 229/117.13; 229/117.22; 229/199; 493/89; 493/128; 493/151; 493/909

[58] Field of Search ..... 229/117.12, 117.13, 229/117.22, 117.23, 199; 493/88, 89, 128, 150, 151, 183, 909

[56] References Cited

U.S. PATENT DOCUMENTS

| | | | |
|---|---|---|---|
| 2,797,856 | 7/1957 | Jaeschke | 229/117.13 |
| 2,955,739 | 10/1960 | Collura | 229/117.13 |
| 2,986,324 | 5/1961 | Anderson, Jr. | 229/199 |
| 3,094,268 | 6/1963 | Swanson et al. | 229/117.13 |
| 3,101,886 | 8/1963 | Ring | 229/117.13 |
| 4,411,383 | 10/1983 | Morris | 229/117.12 |
| 4,418,864 | 12/1983 | Nielsen | 229/117.22 |
| 4,498,619 | 2/1985 | Roccaforte | 229/117.22 |
| 5,718,369 | 2/1998 | Delisle et al. | 229/117.13 |

FOREIGN PATENT DOCUMENTS

| | | | |
|---|---|---|---|
| A 2 481 231 | 10/1981 | France . | |
| A 2 483 885 | 12/1981 | France . | |
| 3200984 | 9/1982 | Germany | 229/117.12 |
| 1240549 | 7/1971 | United Kingdom | 229/117.12 |
| A 2 206 564 | 1/1989 | United Kingdom . | |

*Primary Examiner*—Gary E. Elkins

*Attorney, Agent, or Firm*—Merchant, Gould, Smith, Edell, Welter & Schmidt, P.A.

[57] ABSTRACT

The invention pertains to a carton, a blank and a process for manufacturing a carton of sheet material. The carton includes a cover formed by inner and outer flaps, and two sinkable corner regions situated respectively on either side of the carton or of the cover, straddling the fold lines corresponding to two walls and two opposing flaps. It includes an elongate handle comprising a lower band made of a sheet material formed at least in part by a detachable part belonging to at least one outer flap and a reinforcing upper band secured to the lower band having ends fixed on each side to opposing lateral walls, underneath the sinkable corner regions with respect to the upper face of the cover. The handle encompasses or extends opposite the sinkable corner regions so that, when the handle is pulled substantially perpendicularly to the upper face of the cover, handle portions situated opposite the sinkable corner regions sink into the regions.

16 Claims, 8 Drawing Sheets

FIG. 1A
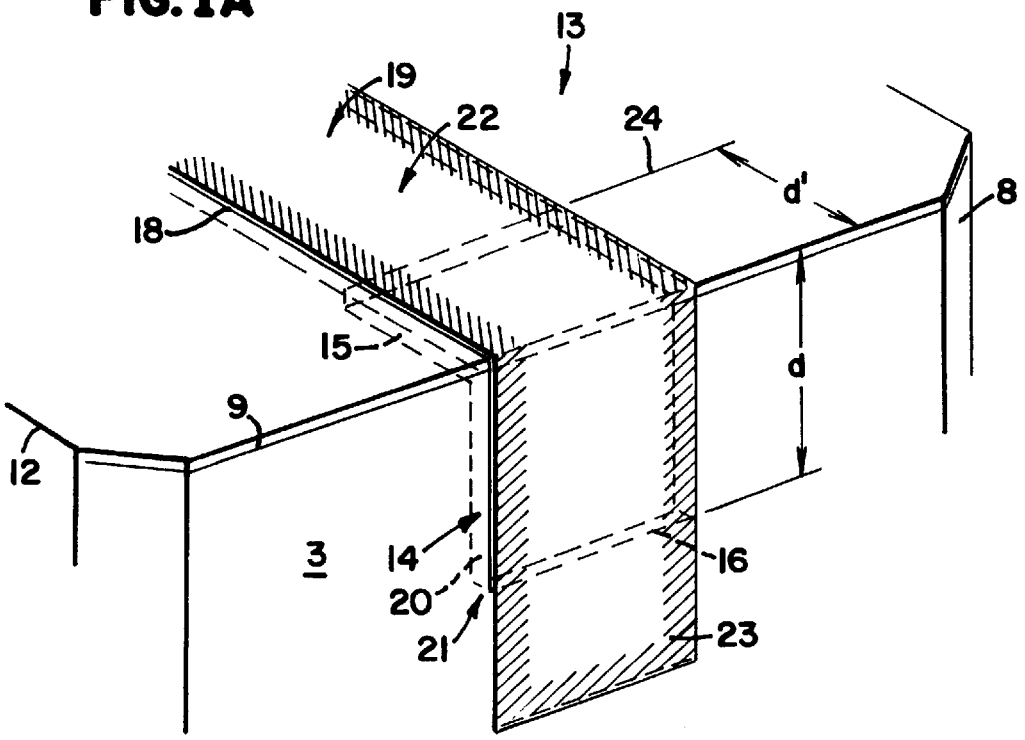
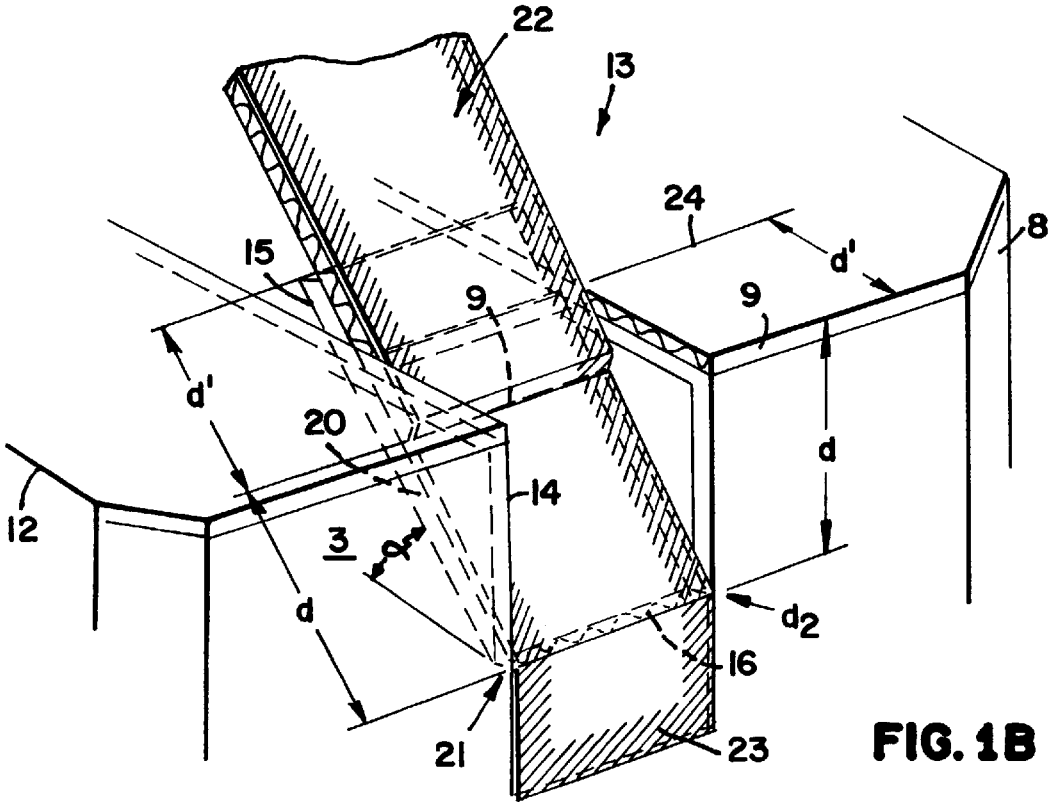
FIG. 1B

FIG. 1C
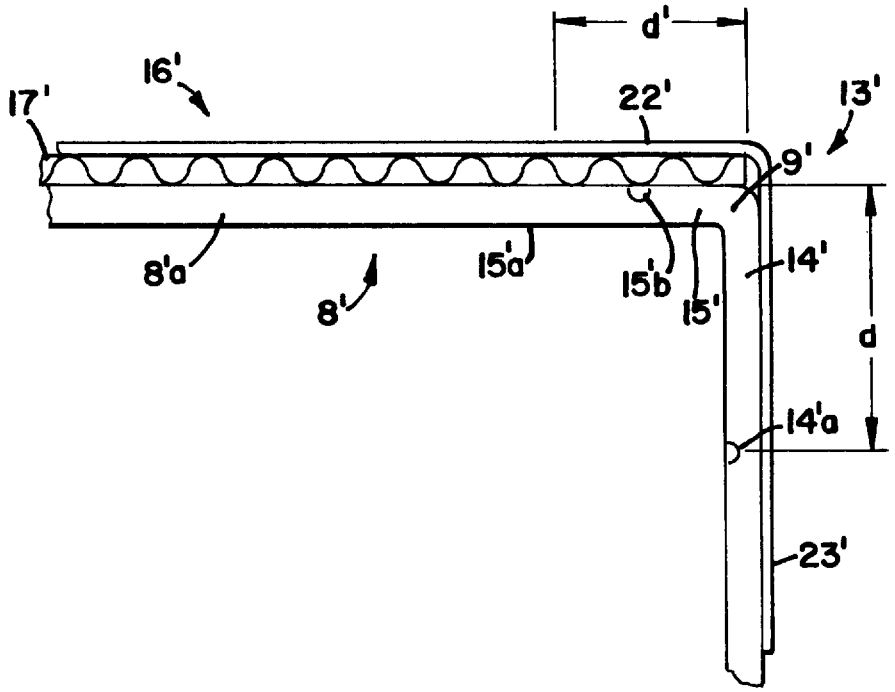
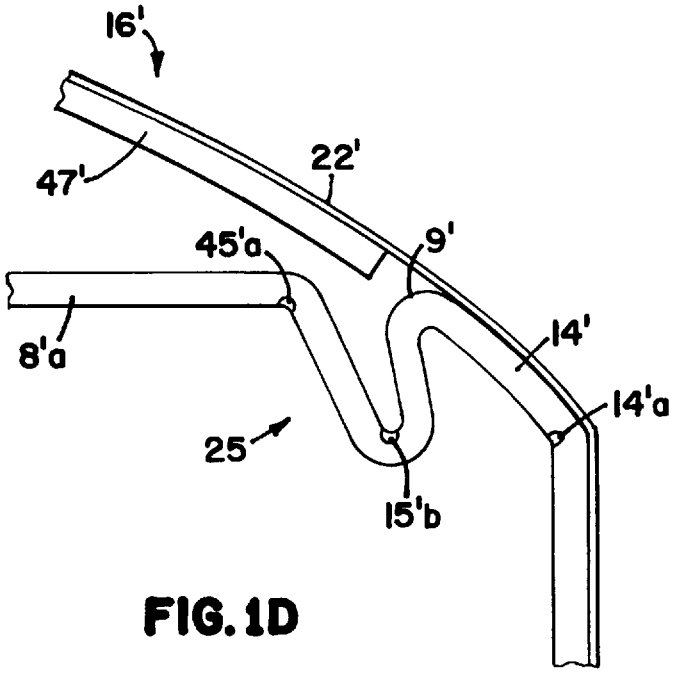
FIG. 1D

FIG. 4
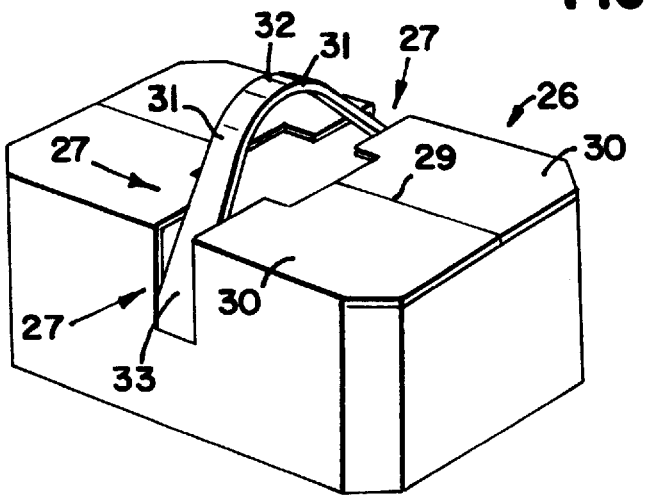
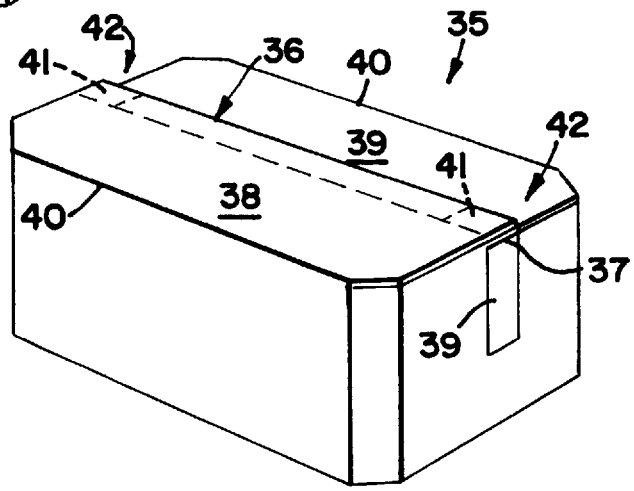
FIG. 5
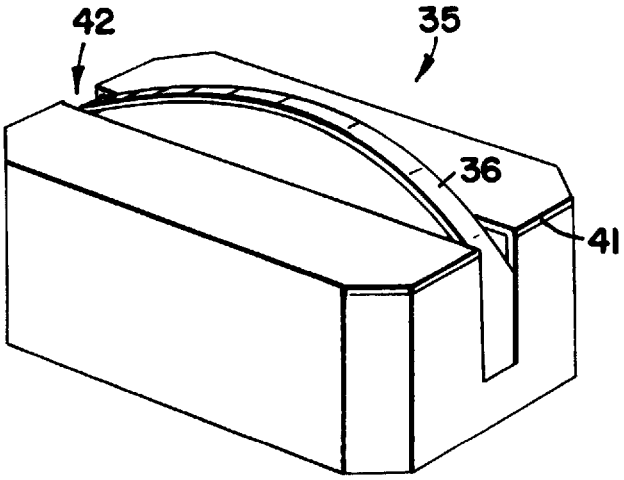
FIG. 6

CARTON OR CARTON COVER OF RIGID SHEET MATERIAL WITH REINFORCED HANDLE, BLANK AND PROCESS FOR MANUFACTURING SUCH A CARTON OR SUCH A COVER

The present invention relates to a carton or a carton cover of sheet material such as flat board, corrugated board or an equivalent, relatively rigid material, including at least four rectangular lateral walls connected together by parallel join lines and an assembly of upper flaps intended to form the upper face of the cover and connected to the said lateral walls by fold lines orthogonal to the join lines, namely two so-called inner flaps and two so-called outer flaps, each inner flap being secured to a lateral wall situated between two lateral walls respectively furnished with an outer flap.

It also relates to a blank for making up such a carton or such a cover, and a method of manufacturing such a carton or such a cover with a handle.

It finds a particularly important though non-exclusive application in the field of parallelepipedal cartons or ones more generally of polygonal horizontal cross-section, made from double-faced corrugated board and intended to contain fairly heavy products possibly weighing up to several kilograms, such as bottles of water for example, and including an upper face perpendicular to the lateral faces of the carton, therefore forming a cover at right angles to these faces.

Systems are already known having attached handles made for example from plastic or metal which are hooked onto a cord, a twine or a band which then completely surrounds the carton. These systems are however complicated to implement and prevent the palletizating of the cartons.

The latter can in fact no longer be overlaid given the projections exhibited by the handles and/or twines surrounding the cartons.

Boxes made from board are also known (GB-A-2,206,564) which comprise a plane upper face, made in one piece, from which is cut out a band serving as handle or grasp.

The band is reinforced for example be cords, or by a band incorporated with the board during manufacture.

Here again, such a solution has drawbacks, especially manufacturing drawbacks.

The present invention aims to provide a carton or a carton cover, blanks and a process for manufacturing a carton or a carton cover with handle which is a better answer than those preciously known to the practical demands in particular in that it proposes a simple, strong, inexpensive handle, which is comfortable to grip, favouring the palletizing of the cartons and allowing the transporting by a user of a carton, possibly containing a relatively heavy and bulky product, with just one hand.

For this purpose, the invention proposes, in particular, a carton or cover of board sheet material including a least four rectangular lateral walls connected together by parallel join lines and an assembly of upper flaps intended to form the cover and connected to the said lateral walls by fold lines orthogonal to the join lines, namely two so-called inner flaps and two so-called outer flaps, each inner flaps being secured to a lateral wall situated between two lateral walls respectively furnished with an outer flap, characterized in that the said carton or the said cover includes two sinkable corner regions, situated respectively on either side of the carton or of the cover, straddling the fold lines corresponding to two opposing walls, and in that it includes an elongated handle comprising a lower band made of a sheet material formed at least in part by a detachable part belonging to at least one of the said outer flaps and a reinforcing upper band secured to the said lower hand and the ends of which are fixed on each side to the said opposing lateral walls, underneath the regions with respect to the upper face of the cover, the handle encompassing or extending opposite the said regions so that, when the handle is pulled substantially perpendicularly to the upper face of the cover, the handle elements situated opposite the said regions sink at least partly into the carton, squashing and/or penetrating the said regions.

In advantageous embodiments, one and/or other of the following provisions is additionally, resorted to;

the upper band is fixed to the lower band and to the lateral walls by gluing;

the upper face of the cover is perpendicular to the lateral walls;

the sinkable regions comprise a lower part cut out from the corresponding lateral wall, and extending downwards over a specified distance d from the fold line and a slit or frangible upper part extending in the upper face of the cover;

the upper part of the region is formed by a recess in an inner lateral flap over a specified distance d' from the fold line;

the upper part of the region is cut out laterally square of substantially square with the upper and lower bands from an inner flap, is connected on one side to the fold line and on the other side, away from the fold line, to the external border of the said flap by a first end grooving and comprises a second intermediate grooving parallel to the fold line of the said inner flap, the said groovings being laid out so as to facilitate the expunging of the said upper part of the region during the tensioning of the handle;

the sinkable regions are situated in the prolongation of a line parallel to or coincident with the join line between the opposing outer flaps, the lower band of the handle consisting of a peripheral border detachable from one of the said outer flaps;

the peripheral borders of the outer flaps partly overlap over a width at least equal to that of the handle;

the sinkable regions are situated in the prolongation of a line parallel to or coincident with the opposite borders of the inner flaps, the lower band of the handle comprising two central portions of sheet material, these being identical and facing each other, each portion belonging respectively to an outer flap, the said portions being situated in the prolongation of the said regions, symmetrically with respect to the separating line or space between the said outer flaps;

the upper face of the cover of the carton exhibits an open or frangible central portion distributed around the handle, allowing easier grasping of the said handle by a user;

the regions are laid out so as to allow the elongate handle to bear on the products arranged inside the carton.

The invention also proposes a blank of corrugated board or similar sheet material for making a cover or a carton, the said blank including:

a string of rectangular panels connected together by first mutually parallel fold lines; and an assembly of upper flaps arranged on one side of the said string of panels, connected to this string by second fold lines perpendicular to the said first fold lines and intended to form the upper face of the said carton or of the said cover, the said assembly of upper flaps including inner flaps for forming at least in part the inner part of the said upper face and outer flaps for forming the outer part of the said upper face, characterized in that it includes at lease two frangible or at least partly slit regions, respectively straddling and centred laterally on the second fold lines of two non-adjacent flaps termed first flaps, intended to form two opposing flaps of the upper face of the carton or of the cover, the said regions each extending either side of the said second corresponding fold line over determined distances, and in that at least one flap includes a rectangular tab or a rectangular tab portion detachable from the said flap, laid out so as to be in the prolongation of the said regions when the cover is formed.

In advantageous embodiments, one and/or other of the following provisions is additionally, resorted to:

the first flaps are the inner flaps, the central part of the detachable tab consisting of the peripheral border of one of the outer flaps, the sum of the widths of the said outer flaps being equal or substantially equal to the width of the cover;

the first flaps are the inner flaps, the central part of the detachable tab consisting of the peripheral border of one of the outer flaps, the sum of the widths of the said outer flaps being greater than the width of the cover by a value equal to or substantially equal to the width of the handle;

the first flaps are the outer flaps, the detachable tab consisting of two portions of the said identical outer flaps which are situated respectively in the prolongation of the regions, perpendicularly and towards the outside of the said panels with respect to the corresponding second fold lines;

the assembly of flaps comprising four flaps, the other two flaps of the said assembly, termed second flaps, including facing peripheral borders having respectively at their lateral end a recess or a frangible part able to be superimposed at least partly with the part termed of the said upper part regions belonging to the first two flaps.

The invention also proposes a process for manufacturing cartons of covers such as described above.

Advantageously, the invention proposes a process for manufacturing a carton or a carton cover with a handle from a blank of the type described above, in which, after forming the body of the carton and filling the latter with the products to be packaged, the inner and outer flaps are closed up and then a first end of an upper band is glued underneath and over a first frangible region, and then over the end part of parts of the outer flap of flaps intended to form the central part of the lower band, and finally the other end of the external band is glued underneath the other facing region, so that the elongate handle can move between a first flat position in which it hugs the outline of the carton, and a second position, for grasping, partly separated from the cover, in which it penetrates into the said regions.

The invention will be better understood on reading the description which follows of particular embodiments given by way of non-limiting example.

The description refers to the drawings which accompany it in which:

FIGS. 1A and 1B show, on a large scale and in partial perspective, the regions of the carton of FIG. 1 in the storage position and in the transport position after tensioning the handle.

FIGS. 1C and 1D show in section before and after tensioning the handle, another region embodiment according to the invention.

FIGS. 3 to 4 are perspective views showing a second embodiment of the carton according to the invention, before and after tensioning the handle.

FIGS. 5 and 6 are perspective views showing a third embodiment of a carton according to the invention, here again before and after tensioning the handle.

Figure 1:
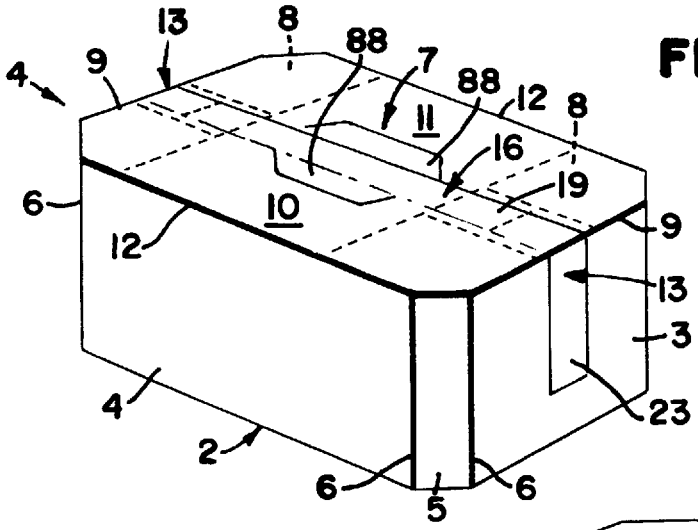
FIG. 1 is a perspective view showing a first embodiment of a carton according to the invention.

FIG. 1 shows a parallelepipedal carton 1 with 8 sides, made from double-faced corrugated board, for example 5 mm thick, for bottles of water, including a bottom 2, four main lateral walls namely two small walls 3 and two large walls 4, separated from one another by secondary walls 5 forming cut corners. The main and secondary walls are connected together by join or fold lines 6.

The carton 1 comprises an upper face 7 perpendicular to the walls and, composed of two small inner flaps 8 (shown dashed in FIG. 1) respectively connected to the small main lateral walls 3 by fold lines 9 orthogonal to the join lines 6 and of two large outer flaps 10 and 11 respectively connected to the large lateral walls 4 by fold lines 12 also orthogonal to the join lines 6.

The carton 1 includes two sinkable or expungable corner regions 13 situated on either side of the carton, straddling the fold lines 9.

The regions 13 (see FIGS. 1A and 1B) are for example formed by a first part 14, termed the lower part, which is rectangular and cut from the upper peripheral border of the wall 3, (it can also be slit into the said border), extending in the wall downwards over a first determined distance d greater than of the order of 1 cm, for example 5 cm, from the fold line 9 and a second rectangular part 15, termed the upper part, which is cut out fully or slit from the corresponding inner flap 8, extending in the said flap over a second determined distance d' greater than of the order of a centimeter, for example also five centimeters, from the said fold line 9.

The carton 1 (cf. FIG. 2 also) moreover includes an elongate handle 16 comprising a rectangular lower band 17, made from a sheet material formed over most of its length, by a rectangular central part 18 detachable from the flap 10, for example owing to partial precutting (shown dashed in FIG. 1), the said central part 18 consisting of the peripheral border 19 of the flap 18 consisting of the peripheral border 19 of the flap 10, on the opposite side from the fold line 12, and of two end parts 20 formed by the first rectangular parts 14 cut out from the upper peripheral border of the walls 3, one of the borders of which is contiguous with the central part 18 at each of its ends and the other border 21 of which remains secured to the wall 3 by a fold line or join line, possibly preformed by grooving.

The handle 16 moreover comprises an upper reinforcing band 22 consisting of a self-adhesive band manufactured for example by the 3M company, secured by gluing to the lower band 17.

According to the embodiment of the invention more particularly described here, the ends 23 of the band are fixed by gluing on each side to the walls 3, underneath the regions 13 with respect to the fold lines 9, that is to say underneath the line 21, for example over a height of the order of 1 to 8 cm, for example 4 cm.

Figure 2:
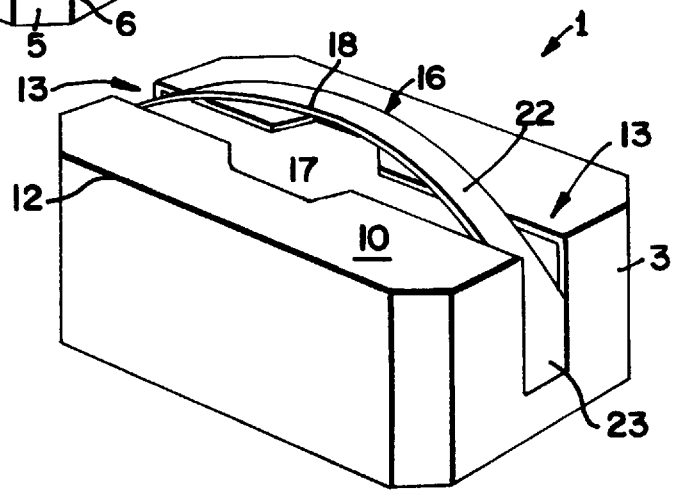
FIG. 2 shows more generally the carton of FIG. 1 after tensioning the handle.

When the handle is pulled substantially perpendicularly to the upper face of the cover, the handle 16 sinks into the regions 13, into which regions it digs as shown in FIGS. 1B and 2.

Distances d and d' are for example laid out so that, when the handle is pulled upwards, it forms an angle $\alpha$ of between 30° and 45° with the horizontal, at the level of the said regions.

The handle 16 then comes into internal abutment on the line 24 parallel to the line 9 and situated at a distance d' from the latter, either directly via the internal face of the central part 18 when the rectangular part 15 is slit, or via the said rectangular part 15, forming an abutment cushion, when this part is cut out fully from the inner flap 8 (cf. FIG 1B).

Represented in section in FIGS. 1C and 1D is another embodiment of the regions 13' with handle 16' formed from a lower band 17' and an upper self-adhesive band 22'.

Each region 13' consists of a first rectangular part 14' terminating at the bottom part in a groove 14'*a* and at the top part in a fold line 9', the distance between the lines 9' and 14'*a,* which are moreover parallel, being d, and of a second part 15', cut out laterally from the internal flap 8', and terminating on one side in the fold line 9' and on the other side in a grooving 15'*a* for joining with the external part 8'*a* of the said internal flap which is furthest from the line 9', the distance between the line 9' and the grooving 15'*a,* which are moreover parallel to one another, being d'.

A second intermediate grooving 15'*b* parallel to the grooving 15'*a* is also provided, allowing easy formation of the fold 25 when tensioning the handle (see FIG. 1D).

Figure 3:
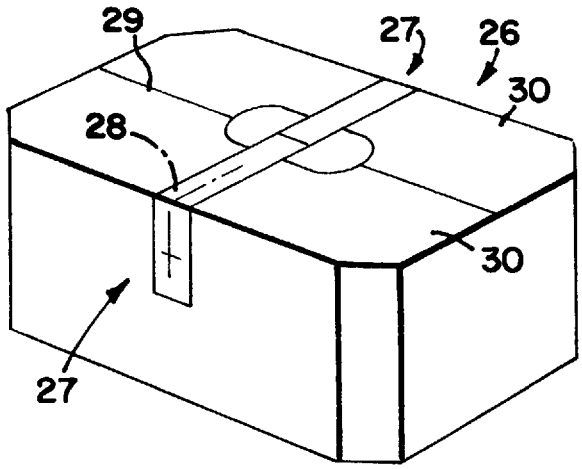

Represented in FIG. 3 and 4 is carton 26 according to another embodiment of the invention, in which the sinkable regions 27 extend around a plane of symmetry 28 orthogonal to the existing join line 29 between the two large outer flaps 30, which constitute the upper face of the cover, and parallel to the peripheral borders of the inner panels (not represented).

More precisely, the two outer flaps 30 are identical and have peripheral borders 29 which are adjoining, making it possible to obtain a continuous upper face.

In this embodiment, the lower band of the handle is formed by two identical portions 31 each belonging to an outer flap, the said portions adjoining at their central ends 32, and fastened to the first parts 33 of the regions 27 at the other of their ends, the said portions 31 being in the prolongation of the regions 27. In the case in which the inner flaps do not have large width, it is not necessary to provide recesses in the said inner flaps.

FIG. 5 and 6 show another embodiment of a carton 35 according to the invention, of the type of that of FIG. 1, but in which the peripheral borders 36 and 37 of the external flaps 38 and 29, away from the fold lines 40, overlap over a width equal to that of the handle and over a central length equal to the length of the handle less the width of the recesses 41 (shown dashed in FIG. 5) of the regions 42, so as to allow the digging in of the handle during tensioning.

Such an arrangement makes it possible to prevent access to the inside of the carton.

Represented in FIGS. 7 to 10 are blanks according to the embodiments of the invention which are more particularly described here, making it possible to produce the above cartons.

For simplicity, the same reference numerals are used below to designate identical elements.

FIGS. 7 to 10 show blanks 44, 45, 46, 47 comprising eight panels, namely, two large panels 48, and two interposed small panels 49 separated respectively by four cut zones 50 devoid of flaps, and connected together by first parallel fold lines 51, and a gluing tab 52 for forming cartons with cut corners.

The large and small panels are each furnished on one side with a lower flap 53 connected by third fold lines 54 perpendicular to the first lines 51, to form the bottom of the carton, and including on the other side upper flaps 55, to form the upper face of the cover, which are likewise connected to their respective panels by second fold lines 56 perpendicular to the said first lines 51.

Two non-adjacent upper flaps and two non-adjacent lower flaps, not necessarily fastened to the same panels, are moreover furnished with and borders 57 slanting outwards from the fold lines, to form an octagonal cover and octagonal base in the embodiments of the invention which are more particularly described here.

The blanks 44 to 47 moreover each comprise two frangible and/or at least partly slit regions, straddling and centred laterally on the two fold lines 56 of two non-adjacent flaps termed first flaps 58, 59 or 60, the said regions each extending on either side of the line 56 on one side in the corresponding panel 48 or 49 over a distance d, and on the other side in the corresponding first upper flap 58, 59 or 60, over a second determined distance d', which may be different or equal to d.

Figure 7:
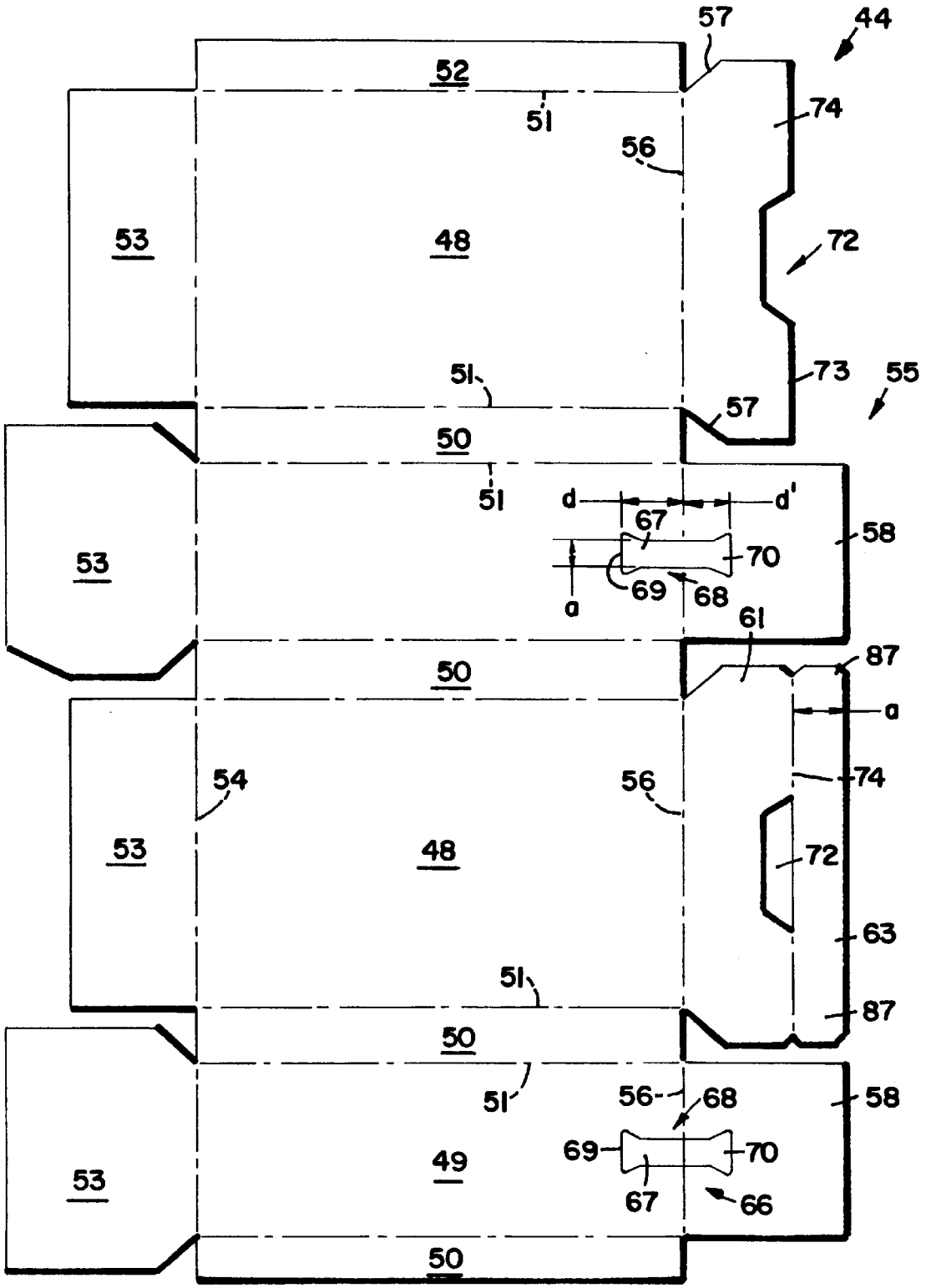
FIGS. 7 to 10 are plan views of blanks according to the invention making it possible to obtain the cartons of FIGS. 1 to 6.

Each blank includes at least one flap 61, 62 or 60 comprising a tab 63, 64 or a tab portion 65 which is detachable from the said flap and is laid out so as to be in the prolongation of the said regions when the cover is formed.

more precisely FIG. 7 shows a blank 44, corresponding to the carton of FIGS. 1 and 2, in which the first flaps 58 are rectangular, identical and intended to form the inner flaps of the carton once formed.

The blank includes regions 66 comprising a so-called lower part 67 belonging to the rectangular panel 49, of width a, and cut out on its lateral borders at 68 and secured by a grooving line 69 with the said panel, and a so-called upper part 70, slit, also rectangular, of the same width, separated from the lower part by the fold line 56, cut out at this location.

The lower and upper parts terminate moreover, for example and in this embodiment, on one side, at the level of the line 69 and on the other side, at the level of the external border of the upper part, in an outwardly splayed trapezoidal widened portion, allowing better formation of the handle.

The detachable tab 63 itself consists of a tearable end band of the outer flap 61, which is parallel to and situated on the other side of the said flap with respect to the fold line 56, over the whole length of the flap, and has a width a equal or substantially equal, for example a little larger, than the width a of the regions 66.

The tab 63 is able to be in the prolongation of the opposite regions 66 when the cover is formed.

The blank 44 included a second outer flap 71, with a width equal to that of the first outer flap less the width a of the tab 63.

Advantageously, recess 72 centred on the cover, for example semi-oval shaped, made on the one hand in the end border 73 of the flap 71 and on the other hand at the level of the partially precut line 74 of the tab 63, are provided.

They allow easy tearing off of the handle by the user.

Figure 8:
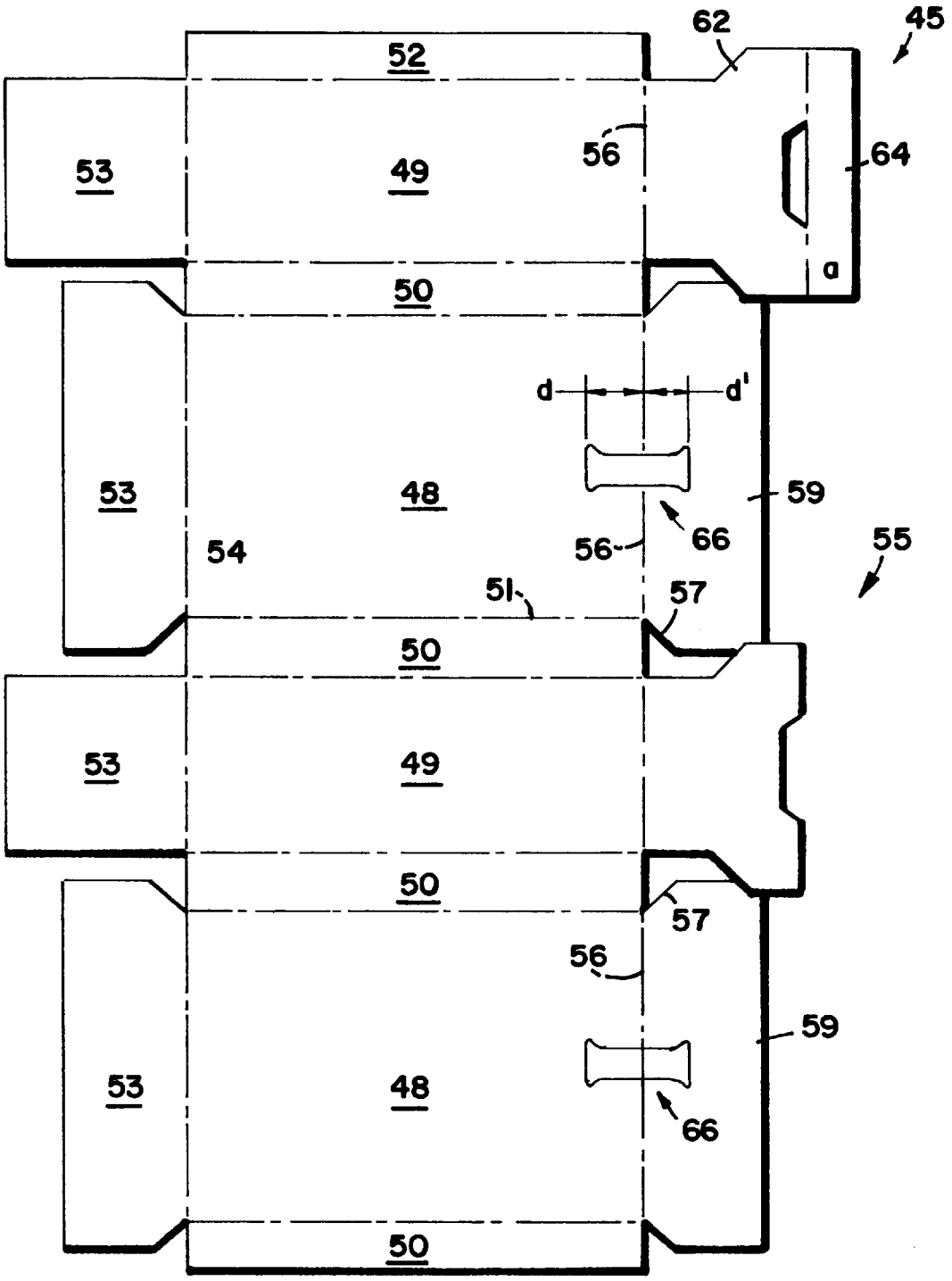

In FIG. 8, the tab 64 has been provided on the end border of a flap 62 corresponding to a small panel 49.

The flap 62 has a Y shape, the base of which consists of the fold line 56.

The regions 66, for example identical to those of FIG. 7, by contrast straddle the fold lines 56 belonging to the large panels 48.

Figure 9:
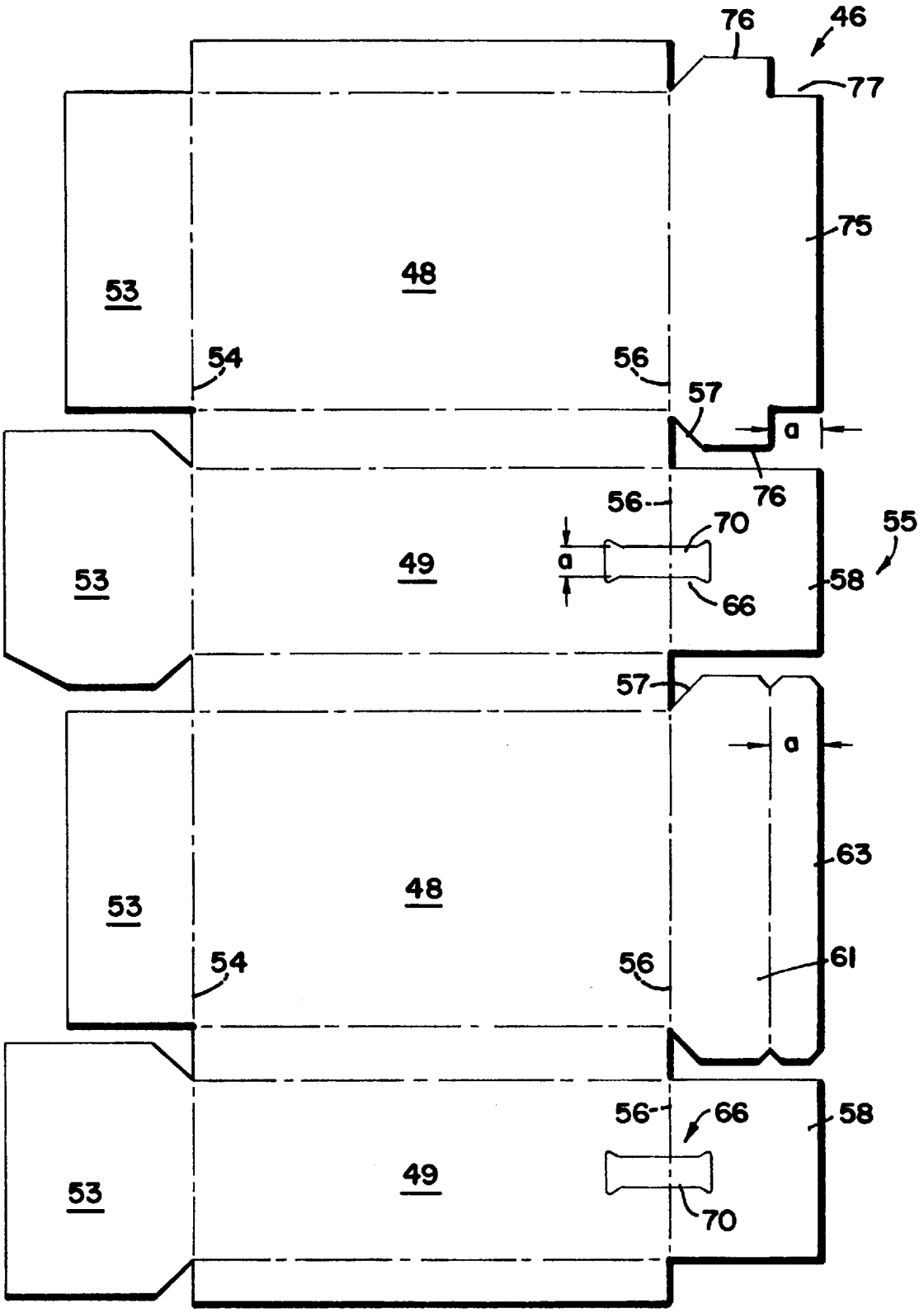

FIG. 9 shows a blank corresponding to the carton of FIGS. 5 and 6.

In this case the second outer flap 75 is of the same width as the panel 61 furnished with the tab 63.

By contrast, at each lateral end 76 it includes a recess or a rectangular frangible region 77 capable of being superimposed with the upper parts 70 of the regions 66 and which is therefore of the same width a as these latter.

Figure 10:
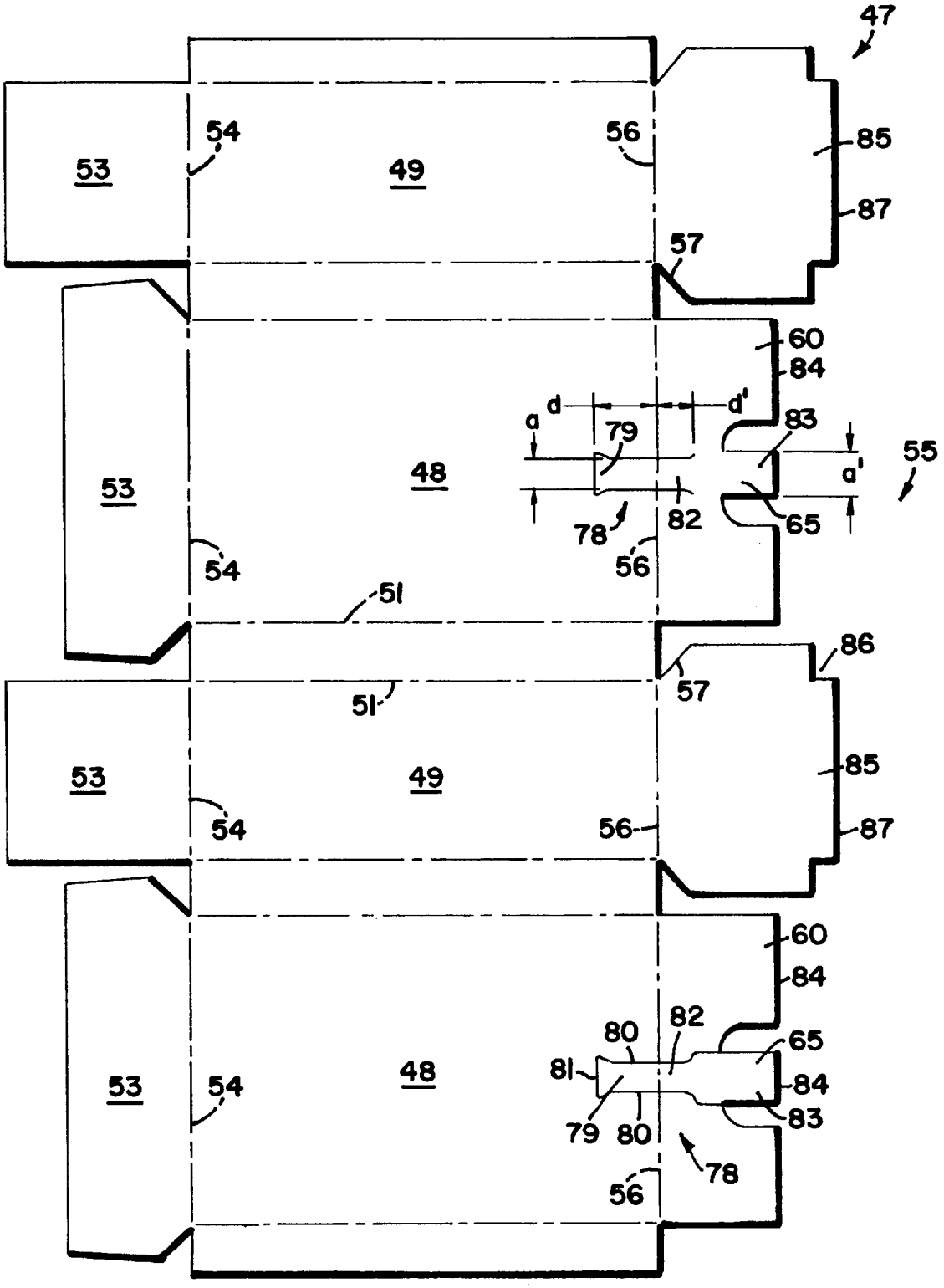

FIG. 10 show another embodiment of a blank 47 according to the invention, corresponding to the carton of FIGS. 5 and 6.

The first flaps 60 are here rectangular and intended to form the outer flaps of the carton once formed.

The blank 47 includes two regions 78, straddling the lines 56 of the panels 48, comprising a so-called lower part 79 belonging to the panel 48, which lower part 79 is rectangular and is cut out or partially precut over its lateral borders at 80 and is secured on one side, by a grooving or prefold line 81, with the panel and on the other side, via the fold line 56, with an upper part belonging to the flap 60, the said upper part consisting of a first central, rectangular portion 82 of width a, attached to the fold line, and a second end portion, 83, of greater width a' for example 1 to 3 mm wider, the said portions 82 and 83 being partially precut over their lateral borders, and hence detachable by tearing from the flap 60 to which they belong, the second portion terminating at the external border 84 of the flap 60, which is parallel to and away from the fold line 56.

When the cover is formed, the two opposite borders 84 are adjoining.

In the embodiment described here, the blank also includes two identical inner upper flaps 85, comprising rectangular semi-notches 86 at their lateral ends, laid out so as to be half superimposed with the portions 82 of the regions 78, the external peripheral borders 87 of the flaps 85 being adjoining when the cover is formed.

The manufacture of a carton will now be described according to one embodiment of the invention, described with reference to FIGS. 1, 2 and 7.

The carton 1 is formed in a known manner, for example around a fixed mandrel as described in the document EP 344.707, starting from the blank of FIG. 7.

Once the carton has been formed, it is ejected, the inner and outer flaps being opened out, then filled with the intended products through the top of the carton, for example with bottles of water.

The flaps 58 are then closed up to form the inner flaps 8 of the carton, the flaps 61 and 71 (10 and 11) being apart. The latter are themselves then folded down after gluing the surfaces of contact between inner flaps and outer flaps, any surfaces which may be in contact at the level of the tearable band 63 which will constitute the lower band of the handle, not, of course, being glued.

The ends 87 of the band 63 are then and furthermore situated structurally opposite the recesses 70 of the regions 66.

The upper band, of the same width as the said tearable band, consisting for example of a one-sided self-adhesive tape of known type, is then stuck by partial winding around the cover.

The band is firstly fixed underneath a first region 66, for example over 2 to 5 cm, then over the frangible part 67 of the said region, then after crossing the fold line 56 over the tearable tab or band 63, then over the frangible part 67 of the other region 66 opposite, and finally underneath the said other region, for example over the same distance of 2 to 5 cm.

As may be seen in the figures, no nuisance projection is observed, thus permitting perfect palletization.

When it is desired to grab hold of the carton, the band 63 is seized, this being facilitated by the spaces 88 (see FIG. 1) due to the recesses 72 provided around the handle (see FIG. 7). The band 63 is then torn by pulling upwards, thereby causing the frangible regions 67 to sink into the carton, the end parts of the handle, which are situated above the fixing points under the regions 66, digging into the recesses 70.

It is thus possible to transport the carton with one hand as described earlier.

As is self-evident and as results moreover from the foregoing, the present invention is not limited to the embodiments more particularly described.

On the contrary it embraces all the variants thereof and in particular those in which:

the carton includes only four walls, the borders of the inner flaps are not adjoining, in particular in the case of the embodiment corresponding in FIGS. 5 and 6, only a cover is involved, that is to say there is no provision for lower flaps to constitute a bottom.

We claim:

1. Carton or cover of board sheet material including at least four rectangular lateral walls connected together by parallel join lines and an assembly of upper flaps intended to form an upper face of said cover and connected to said lateral walls by fold lines orthogonal to the join lines, said upper flaps comprising two inner flaps and two outer flaps, each of said two inner flaps being secured to one of said four lateral walls situated between two of said four lateral walls respectively furnished with one of said two outer flaps, wherein said carton or said cover included two sinkable corner regions situated respectively on either side of the carton or of the cover, straddling the fold lines corresponding to two opposing walls of said four lateral walls, wherein said carton includes an elongate handle comprising a lower band made of sheet material formed of three separated parts, one central part formed by a detachable part belonging to at least one of said outer flaps, and two end parts formed by rectangular parts precut or cut out from an upper peripheral border of said opposing walls and a reinforcing upper band secured to said lower band having ends fixed on each side to said opposing walls, underneath said sinkable corner regions with respect to the upper face of the cover, the handle encompassing or extending opposite said sinkable corner regions so that, when the handle is pulled substantially perpendicularly to the upper face of the cover, handle portions situated opposite said sinkable corner regions sink into the carton, squashing and/or penetrating said sinkable corner regions, and wherein each of said sinkable corner regions comprises a lower part corresponding to one of said end parts partly precut or cut out from one of said opposing walls and extending downwards over a specific distance d from a corresponding fold line and a slit or frangible upper part extending in the upper face of the cover.

2. Carton according to claim 1, wherein the upper band is fixed to the lower band and to said opposing walls by gluing.

3. Carton according to claim 1, wherein the upper face of the cover is perpendicular to the lateral walls.

4. Carton according to claim 1, wherein each upper part of said sinkable corner regions is formed by a recess in one of said inner flaps over a specified distance d' from said corresponding fold line.

5. Carton according to claim 1, wherein each upper part of said sinkable corner regions is cut laterally square with the upper and lower bands from each of said inner flaps being connected on one side to one of said fold lines orthogonal to join lines and on an other side, away from said one of said fold lines, to an external border of said inner flap by a first end grooving and comprises a second intermediate grooving parallel to said one of said fold lines, in order to facilitate an expunging of said sinkable regions during tensioning of the handle.

6. Carton according to claim 1, wherein each of said outer flaps having a peripheral border being separated from each other by a contact line, the sinkable regions are situated parallel to or coincident with said contact line, the lower band of the handle consisting of at least one of said peripheral borders detachable from at least one of said outer flaps.

7. Carton according to claim 6, wherein said peripheral borders of the outer flaps partly overlap over a width at least equal to that of the handle.

8. Carton according to claim 1, wherein each of said inner flaps having respective opposite borders, the sinkable corner regions are parallel to or coincident with said opposite borders of the inner flaps, the central part of the lower band of the handle comprising two central portions of sheet material, each central portion belonging respectively to one of said outer flaps and being situated in prolongation of said sinkable corner regions.

9. Carton according claim 1, wherein the upper face of the cover exhibits an open or frangible middle portion distributed around the handle, allowing easier grasping of said handle by a user.

10. Carton according claim 1, wherein said sinkable corner regions are laid out so as to allow the elongate handle to bear on products when such products are arranged inside the carton.

11. Blank of corrugated board or similar sheet material for making a cover or a carton of polygonal cross-section, the blank including:

a string of rectangular panels connected together by first mutually parallel fold lines; and an assembly of upper flaps arranged on one side of said string of panels, connected to said string by second fold lines perpendicular to said first fold lines and intended to form the upper face of said carton or of said cover, said assembly of upper flaps including inner flaps for forming at least in part an inner part of said upper face and outer flaps for forming an outer part of the upper face, wherein the blank further includes at least two partly slit regions, each straddling and centered laterally on a corresponding second fold line of one of said upper flaps intended to form two opposing flaps of the upper face of the cover, said partly slit regions each extending on both sides of said corresponding second fold line over determined distances.

wherein at least one of said upper flaps includes a rectangular tab portion detachable from said one of said upper flaps, laid out so as to be in the prolongation of said partly slit regions when the cover is formed, and wherein each of said partly slit regions comprises a lower part partly recut or cut out from one of said corresponding rectangular panels, and over a specified distance d and a slit or frangible upper part extending in one of said upper flaps adjacent to said corresponding rectangular panels separated from said lower part.

12. Blank according to claim 11, wherein each of said outer flaps having a peripheral border, the upper flaps including opposite partly slit regions are the inner flaps, said rectangular tab portion having a central part consisting of the peripheral border of one of said outer flaps, the sum of the widths of said outer flaps being equal or substantially equal to the width of the cover.

13. Blank according to claim 11, wherein each of said outer flaps having a peripheral border, the upper flaps including partly slit regions are the inner flaps, said rectangular tab portion having a central part consisting of the peripheral border of one of said outer flaps, the sum of the width of said outer flaps being greater than the width of the cover by a value equal to or substantially equal to the width of said rectangular tab portion.

14. Blank according to claim 11, wherein the upper flaps including partly slit regions are the outer flaps, said rectangular tab portion consisting of two portions of said outer flaps which are situated opposite one another in prolongation of said partly slit regions towards the outside of said panels with respect to corresponding second fold lines when the blank is formed into carton.

15. Blank according to claim 11, wherein two flaps of said upper flaps having facing peripheral borders with lateral ends includes at said lateral end recesses or frangible parts arranged to be superimposed at least partly with a part of said partly slit regions.

16. Process for manufacturing cartons or carton covers with a handle from a blank, the blank including:

a string of rectangular panels connected together by first mutually parallel fold lines; and an assembly of upper flaps arranged on one side of the string of panels, connected to said string by second fold lines perpendicular to said first fold lines and intended to form an upper face of the carton or of the cover, said assembly of lateral flaps including inner flaps for forming an inner part of said upper face and outer flaps for forming an outer part of said upper face, the blank including at least two partly slit regions, respectively straddling and centered laterally on the second fold lines of two non-adjacent said upper flaps, for forming two opposing flaps of the upper face of the carton or of the cover, said partly slit regions each extending on both sides of said second corresponding fold line over determined distances, at least one upper flap including a rectangular tab portion detachable from said one of said upper flaps, laid out so as to be in prolongation of said partly slit regions when the cover is formed, the process comprising the steps of, after forming the carton and filling the latter with products to be packaged, closing the inner and outer flaps on said products gluing a first end of an upper band underneath and over one of said two partly slit regions, and gluing said upper band over an end part of parts of one of said outer flap or flaps intended to form a central part of the lower band, and gluing the other end of said upper band underneath the other one of said partly slit regions, so as to form a handle which can move between a first flat position in which it hugs the carton, and a second position, for grasping, partly separated from the cover, in which said handle penetrated into the partly slit regions.

* * * * *